US005105956A

United States Patent [19]

Tarng-Lin

[11] Patent Number: 5,105,956

[45] Date of Patent: Apr. 21, 1992

[54] NURSING BOTTLE WITH AN EXTENDIBLE NIPPLE

[76] Inventor: Horng Tarng-Lin, 5F, 13, Alley 36, Lane 114, Chung-Shan N. Rd Sec. 7, Taipei, Taiwan

[21] Appl. No.: 625,934

[22] Filed: Dec. 11, 1990

[51] Int. Cl.[5] ..... A61J 9/00; A61J 11/04

[52] U.S. Cl. ..... 215/11.1; 215/1 A; 215/229

[58] Field of Search ..... 215/11.1-11.6, 215/1 A, 229

[56] References Cited

U.S. PATENT DOCUMENTS

| | | | |
|---|---|---|---|
| 3,780 | 10/1844 | Dupuy | 215/11.5 |
| 177,185 | 5/1876 | Whitney | 215/11.1 |
| 234,224 | 11/1880 | Barton | 215/11.1 |
| 323,597 | 8/1885 | Prime | 215/11.1 |
| 468,759 | 2/1892 | Bobrick | 215/11.1 |
| 682,464 | 9/1901 | Graham-Yoll | 215/11.4 |
| 3,065,873 | 11/1962 | Plate | 215/11.1 |
| 3,076,574 | 2/1963 | Woodbury, Jr. et al. | 215/11.1 |
| 3,146,904 | 9/1964 | Hansen et al. | 215/11.1 |
| 4,925,042 | 5/1990 | Chong | 215/11.1 |
| 4,969,564 | 11/1990 | Cohen et al. | 215/11.1 |

FOREIGN PATENT DOCUMENTS

| | | | |
|---|---|---|---|
| 746707 | 11/1966 | Canada | 215/11.1 |
| 3733184 | 4/1989 | Fed. Rep. of Germany | 215/11.1 |
| 2067416 | 7/1981 | United Kingdom | 215/11.4 |

*Primary Examiner*—Sue A. Weaver
*Attorney, Agent, or Firm*—Bacon & Thomas

[57] ABSTRACT

A nursing bottle having a nipple to be connected with an extension hose. It includes a nipple which is able to be connected with an extension hose and extend through a fixing component and a bottle cap into the bottle. A grip jaw is provided on the fixing component which will be contracted in a reception trough or hole on the top of the bottle while the fixing component is screwed on the bottle cap to tightly grip the extension hose. The length of the extension hose is able to be adjusted to extend out of the bottle to facilitate the nursing bottle to be used in offering the nipple to the baby or child for sucking and placing the bottle at a distance and without the need of the nurser or the baby or child having to hold the bottle.

1 Claim, 4 Drawing Sheets

NURSING BOTTLE WITH AN EXTENDIBLE NIPPLE

BACKGROUND OF THE INVENTION

The present invention refers to a nursing bottle with a nipple to be connected with an extension hose, in particular, one end of the extension hose is inserted into the bottle and the other end connected with the nipple. While it is required to have the extension hose extending out of the bottle for an appropriate length on using, the extension hose may be fastened by means of a tightening up device to facilitate suckling by the baby or child by offering it the nipple for sucking and placing the bottle somewhere at a distance and without the need of holding the bottle.

Conventional nursing bottles comprises generally a nipple, the bottle cap, and the bottle. The nursing bottle is connected with the bottle cap directly, in other words, the bottle cap is combined with the bottle to form an integrated structure. On nursing the baby or child, the nursing bottle containing the liquid is held with a hand by the nurser to offer the nipple to the baby or child for sucking. Even though the baby is old enough to hold the bottle by himself, the bottle is often dropped due to the baby or child falling asleep before completely sucking all the liquid in the bottle.

It is desirable therefore that nursing bottle construction be improved in a manner as to eliminate the need of holding the bottle with hand by the nurser to suckle the baby or child, or placing the bottle close to the baby or child.

SUMMARY OF THE INVENTION

The main object of the present invention is to provide a nursing bottle with an extension hose having one end inserted into the nursing bottle and the other end connected with a nipple. While the extension hose is required to be extended to an appropriate length to protrude out of the bottle on using, it is held and fixed tightly on the bottle cap by a grip jaw in order that the nipple may be offered to the baby or child for sucking, with the bottle being left alone aside and without the need to have somebody holding it.

Another object of the present invention is to provide a nursing bottle with a grip jaw; while the extension hose connecting the nipple and the bottle is adjusted to an appropriate required length, the grip jaw will hold and fix the extension hose tightly in order that an appropriate length between the bottle and the nipple may be maintained to facilitate the spacing of the bottle and nipple and permit free sucking by the baby or child.

The above objects, technology, feature and effect of the present invention will become apparent upon the study of the following preferred embodiment and drawings.

DETAILED DESCRIPTION OF THE PRESENT INVENTION

Figure 1:
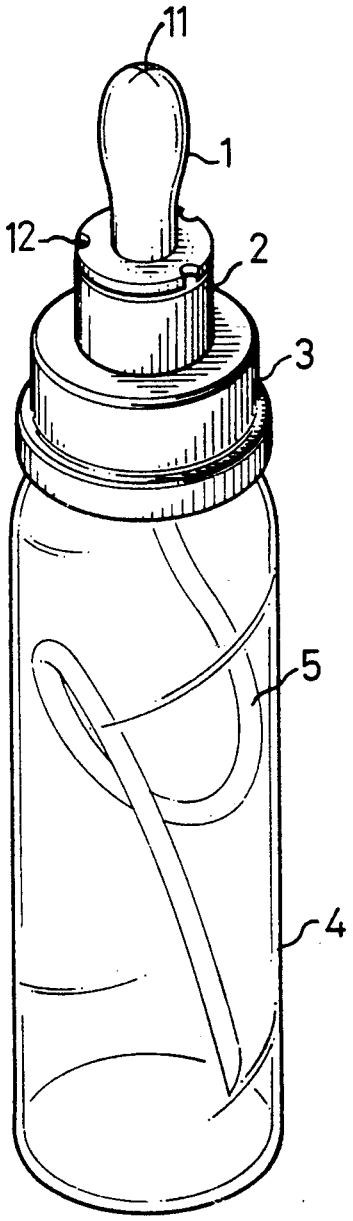
FIG. 1 is a perspective view of the present invention

Referring now to FIG. 1, the present invention is constituted by a nipple (1), a fixing component (2), a bottle cap (3), a nursing bottle (4) and an extension hose (5) to be inserted into the nursing bottle (4), in which one end of the extension hose (5) is connected to the lower end of the nipple (1), and the other end with an opening is inserted into the nursing bottle (4) and submerged into the liquid to be contained by the nursing bottle (4). While the baby or child sucks on the nipple (1), the liquid in the nursing bottle (4) is drawn through the extension hose (5) to exit the sucking hole (11) on the top of the nipple (1) into the mouth of the baby or child. To prevent the air left over in the extension hose (5) from being drawn by the baby or child on sucking the nipple (1), the nurser may suck the nipple (1) to cause the liquid to fill up the extension hose (5) beforehand. The liquid will then never flow back into the nursing bottle (1), and it also reduces the burden of the baby or child to be required to suck forcibly. The nipple (1) is made with elastic latex or other appropriate material in which the sucking hole (11) on the top of the nipple (1) is constituted by cross cutting the inner wall of the nipple (1). Unless the nipple (1) is sucked or pressed, the liquid will not be easily flow out of the nursing bottle (4) through the sucking hole (11). This prevents the fluid from causing staining of clothes once the nipple (1) falls down from the mouth of the baby or child due to carelessness or the baby or child falls asleep during sucking. In addition, some notches (13) are provided on the base (12) of the nipple (1) to prevent the breathing of the baby or child from being affected on account of pressing the base (12) by the nose of the baby or child who sucks forcibly.

Referring again to FIG. 2 and 3, the main components of the present invention in sequence of composition comprise a nursing bottle made of glass or plastic to be combined with the cap (3) by means of a threaded engagement. There is a cylinder extending upwardly in the central part of the cap (3) with threads (31) around it, a circular hole (32) is provided in the center of the cylinder and extends through the cap (3). The upper end of the circular hole (32) tapers from top to bottom to receive the cone grip jaw (21) installed in the fixing component (2), the latter circular fixing component (2) is combined with the cap (3) by means of its inside thread and the external thread (31) of the cylinder on the top of the cap (3). The axle center of the fixing component (2) extends through a circular hole with a cone grip jaw having grooves (22) extending along the axle longitudinally in the central part. While the grip jaw (21) of the fixing component (2) is screwed on the bottle cap (3), the grip jaw slides into the hole (32) of the cap (3), the grooves (22) on the grip jaw (21) contract inward to sealingly engage hole (32) of the cap (3) and prevent the liquid in the nursing bottle from leaking out. A soft extension hose (5) made from the same high temperature endurable sterilized latex or other appropriate material of the nipple (1) extends downward through the fixing component (2) and the grip jaw (21) into the nursing bottle (4) by way of the reception trough (32) of the bottle cap (3). The upper end of the extension hose (5) is encased with a component part (6) having a flange (61) on the upper end to be pressed into the groove (14) of the nipple (1). A nipple (1) made with elastic latex or other appropriate material having a cross sucking hole (11) to be cut in the inner wall of the upper end of the nipple (1) allows the liquid in the nursing bottle (4) to flow out of the sucking hole (11) only when the nipple (1) is sucked or pressed. There is a diskshaped base (12) on the lower end of the nipple (1) to prevent the whole nipple (1) from being carelessly swallowed by the baby or child. There are notches on the flange of the base (12) to prevent the baby or child from suffocating once the base (12) of the nipple (1) is pushed against the nose by forcible sucking. A circular groove (14) is formed in the inner wall of the nipple (1) adjoining the base (12) to permit the flange (61) on the upper end of the component (6) to be pressed through the opening on the lower end of the nipple (1) and encased in the circular groove (14) to fix the extension hose (5) on the nipple (1) and preventing it from falling or sliding off.

Figure 2:
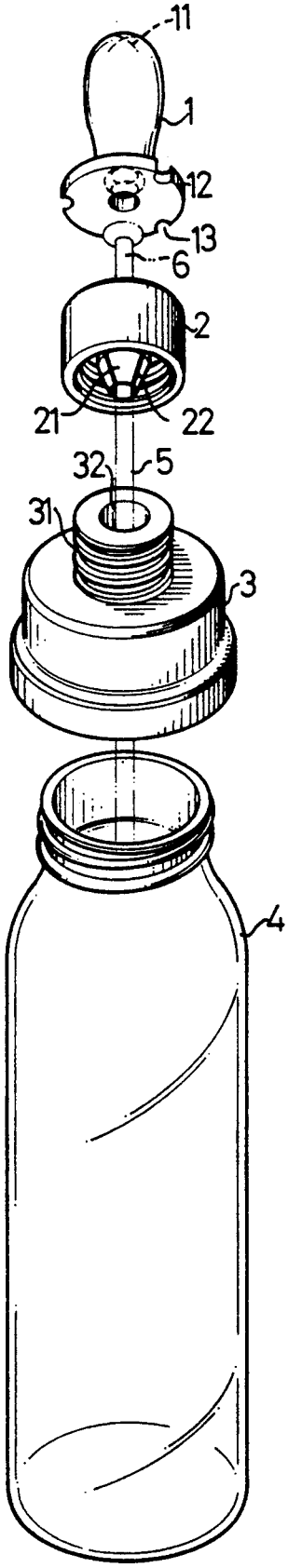
FIG. 2 is an exploded perspective view of the present invention.
Figure 3:
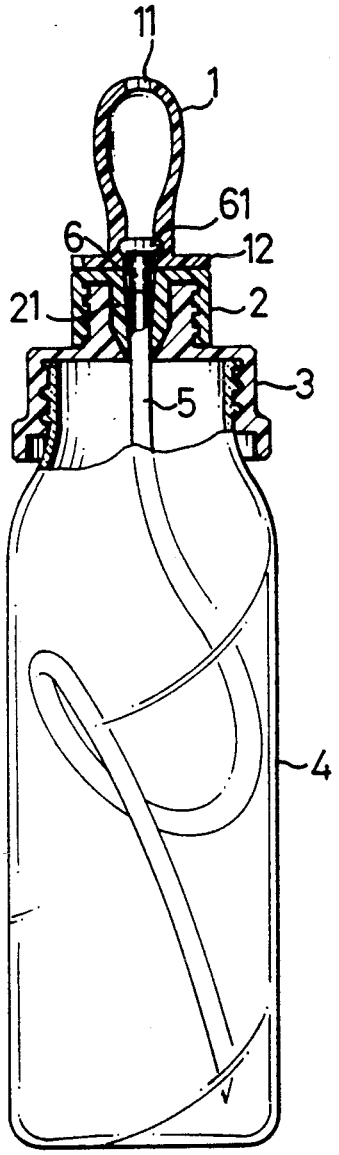
FIG. 3 is a front elevational view, partly in section, of the present invention.
Figure 4:
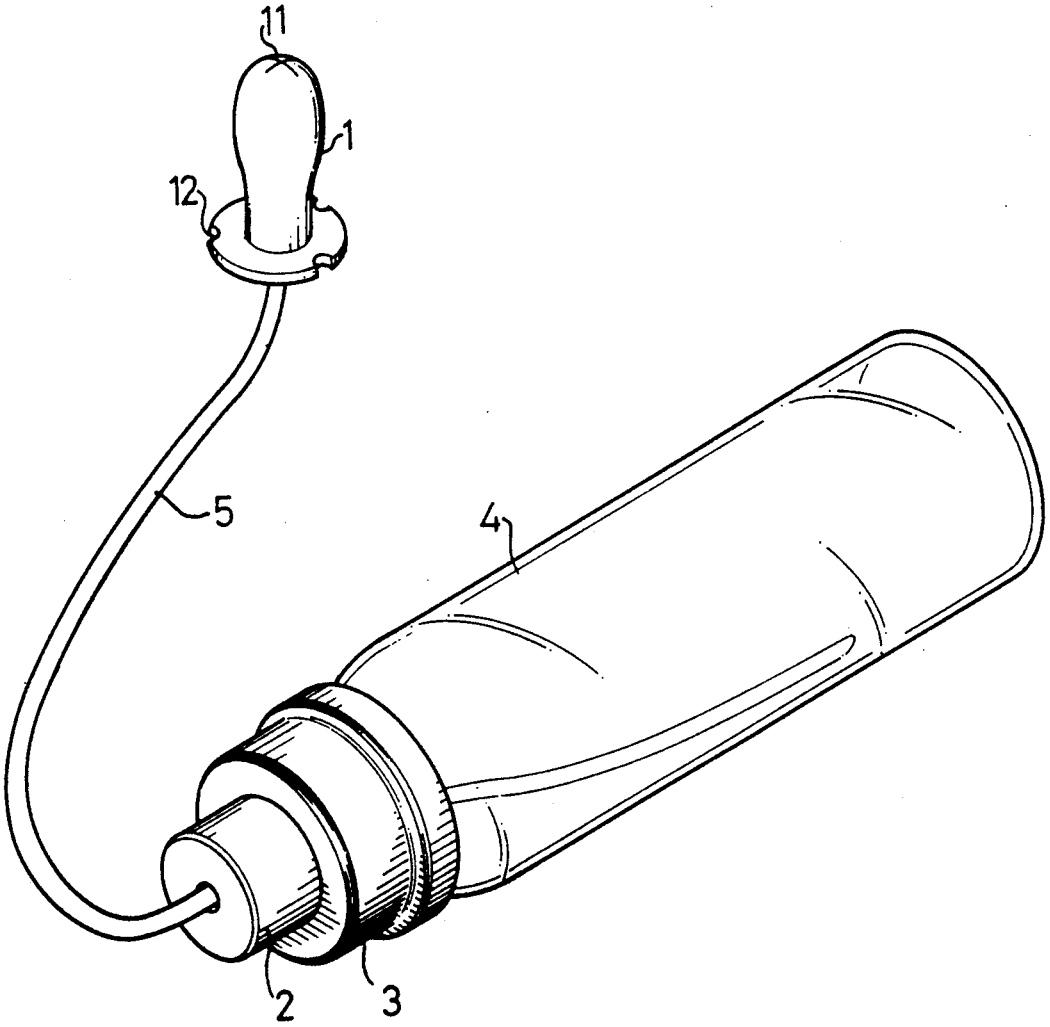
FIG. 4 is a perspective view of the present invention showing the nipple in an extended position.

Referring further to FIG. 1, 2 and 4, on adjusting the position of the nipple (1), the fixing component (2) is loosened from the cap (3) of the bottle. When the grip jaw (21) is removed from the reception trough (32), the grooves (22) of the grip jaw (21) will be loosened to allow the extension hose (5) to be pulled out of the nursing bottle (4) easily. When the extension hose (5) is pulled out to the length required along with the nipple (1) connected therewith, the fixing component (2) is screwed on the base (3) of the bottle. By this time the grip jaw (21) will slide downward to be forced to contract inward to fill in the reception trough (32) closely, and then press and fix the extension hose (5) tightly, as shown in FIG. 4. On sucking by the baby or child, the nipple (1) is offered to the baby or child for sucking. The nursing bottle (4) may be placed somewhere aside without the need to be held by the nurser. While the baby or child sucks the nipple (1), the liquid comes from the bottle (4) to the nipple (1) through the extension hose (5) and then enters into the mouth of the baby or child. The extension hose (5) is able to submerge in the bottom of the liquid due to its softness and weight based on the position of the nursing bottle. The end of the extension hose (5) may be provided with an obliquie opening to permit all the liquid in the bottle to be sucked out.

In addition, the above structure is also applicable to patients who are required to be fed with liquid foods. As can be appreciated, the present invention represents a novel improvement over customary nursing bottles.

I claim:

1. A nursing bottle with extendable nipple comprising:

a) a nipple formed of elastic material and including a cross-sucking hole formed by cutting an inner wall at the top of the nipple for passing liquid therethrough, a disk-shaped base provided with a plurality of notches spaced therearound, and a groove formed around an inner wall adjacent a lower end of the nipple adjoining the base;

b) a nursing bottle provided with a threaded opening at an upper end;

c) a bottle cap including a downwardly extending internally threaded lower skirt for engagement with the threaded opening of the bottle, the bottle cap including a cylinder on an upper portion, the cylinder being provided with an external thread and including a circular hole extending through the cylinder and bottle cap;

d) a fixing component provided with an internal thread on an inner wall for engagement with the external thread of the cylinder, the fixing component including a downwardly extending cone-shaped grip jaw means receivable through the circular hole of the cylinder, the hole including a complimentary reception trough dimensioned to removably and sealingly receive the grip jaw means when the fixing component is threadedly engaged on the cylinder;

e) an extension hose including upper and lower ends, the extension hose extending through the circular hole in the cylinder and the grip jaw means of the fixing component, the upper end of the hose being provided with a flange secured within the groove of the nipple, and the lower end of the hose being disposed within the bottle; and f) whereby when the fixing component is threadedly disengaged from the cylinder, the extension hose may be extended out of or inserted into the bottle to permit the nipple to be positioned at a desired distance from the bottle, with such position being maintained by inserting the grip draw means within the reception trough of the circular hole and threadedly engaging the fixing component to the cylinder.

* * * * *